US007585193B2

(12) United States Patent
Hagmann et al.

(10) Patent No.: US 7,585,193 B2
(45) Date of Patent: Sep. 8, 2009

(54) PLUG-AND-SOCKET CONNECTOR WITH SCREW-TYPE CONNECTION

(75) Inventors: Bernd Hagmann, Geislingen (DE); Johann Krech, Horb am Neckar (DE)

(73) Assignee: Lapp Engineering & Co., Zug (CH)

( * ) Notice: Subject to any disclaimer, the term of this patent is extended or adjusted under 35 U.S.C. 154(b) by 0 days.

(21) Appl. No.: 12/166,827

(22) Filed: Jul. 2, 2008

(65) Prior Publication Data

US 2009/0011660 A1 Jan. 8, 2009

(30) Foreign Application Priority Data

Jul. 4, 2007 (DE) ..... 20 2007 009 351

(51) Int. Cl.
*H01R 4/36* (2006.01)

(52) U.S. Cl. ..... 439/811

(58) Field of Classification Search ..... 439/810–814
See application file for complete search history.

(56) References Cited

U.S. PATENT DOCUMENTS

| | | | | |
|---|---|---|---|---|
| 4,331,377 | A * | 5/1982 | Ebbinghaus et al. | 439/733.1 |
| 5,192,234 | A * | 3/1993 | Heng et al. | 439/806 |
| 5,300,996 | A | 4/1994 | Yokoyama et al. | |
| 5,314,360 | A * | 5/1994 | Jaag | 439/811 |
| 5,596,237 | A * | 1/1997 | Daniels | 310/71 |
| 6,146,212 | A * | 11/2000 | Kipnik | 439/709 |
| 6,210,239 | B1 * | 4/2001 | Harting et al. | 439/814 |
| 6,475,038 | B1 * | 11/2002 | Franck | 439/811 |
| 6,764,355 | B2 * | 7/2004 | Ude et al. | 439/811 |
| 7,048,591 | B1 * | 5/2006 | Chiang | 439/709 |
| 7,086,900 | B2 * | 8/2006 | Comini | 439/598 |

(Continued)

*Primary Examiner*—Ross N Gushi
(74) *Attorney, Agent, or Firm*—Thomas R. FitzGerald; Hiscock & Barclay, LLP

(57) ABSTRACT

An improved electrical plug-and-socket connectors with screw-type clamping connections has a step-shaped screw brake for protecting against loss of the clamping screw of connecting stranded conductors of electrical components having as the clamping mode a screw-type clamping connection. The screw brake has one, two or more strips. The plug-and-socket connector has a screw-type connection, having an insulating part, arranged to accommodate at least one contact insert. The contact insert has a substantially cylindrical shape and comprises a contact portion for electrical/mechanical connection to an oppositely shaped contact piece of a matched plug-and-socket connector at a first end of the contact insert. It further comprises an insertion opening for at least one connecting stranded conductor at a second end of the contact insert, there opening in the insertion opening a screw hole which is oriented substantially transversely relative to the central longitudinal axis thereof and comprises an internal thread. The insulating part has a screw channel which is substantially in alignment with the screw hole when a contact insert is accommodated in the insulating part. The screw channel has at least one step. The inside width of the screw channel reduces from a first, greater dimension towards a second, lesser dimension in the direction towards the screw hole of the insertion opening. The screw channel has one or more strips which are oriented substantially coaxially relative to its central longitudinal axis of the and which are so dimensioned that a clamping screw to be inserted in the screw channel fastening the connecting stranded conductor in the insertion opening of the contact insert is subjected to a first, lesser resistance at the strip/strips of the first inside width, and is subjected to a second, greater resistance at the strip/strips of the second inside width.

16 Claims, 4 Drawing Sheets

U.S. PATENT DOCUMENTS 7,413,487 B1 * 8/2008 Chen ..... 439/811
7,445,526 B2 * 11/2008 Neese et al. ..... 439/811
7,473,146 B2 * 1/2009 Fuzetti et al. ..... 439/798
2006/0155280 A1 * 7/2006 Siebens et al. ..... 606/61
2009/0011660 A1 * 1/2009 Hagmann et al. ..... 439/801

* cited by examiner

PLUG-AND-SOCKET CONNECTOR WITH SCREW-TYPE CONNECTION

CROSS REFERENCE TO RELATED APPLICATIONS

This application claims priority to German Patent Application Number 20 2007 009 351.9 filed Jul. 4, 2007.

DESCRIPTION

Technical Domain

Described in the following is an electrical plug-and-socket connector with screw-type connection for cable stranded conductors or solid wire. This may be an electrical plug-and-socket connector for use with higher voltages and/or currents (rated voltage: up to 600 volt and above (approximately 1000 volt), rated current: up to 16 ampere and above (approximately 80 ampere)), for example for electrical equipment in machine construction, electric switchgear cabinets, lighting and sound cabling, or the like.

BACKGROUND

In the case of electrical plug-and-socket connectors with screw-type clamping connections for the cable stranded conductors, two chord-shaped strips or two semicircular strips are applied, diametrically opposite, to the inner wall of a circular cylindrical opening for the clamping screw, in order to secure the stranded-conductor clamping screws so that they cannot be lost during transport.

As the clamping screws are screwed in, the strips press against the outer diameter of the screw head. The strips are applied over the entire length of the circular cylindrical opening, except for the insertion chamfer.

Problem

There is a need for improved electrical plug-and-socket connectors with screw-type clamping connections.

Solution

There is proposed for this purpose a step-shaped screw brake as a means of protecting against loss of the clamping screw of connecting stranded conductors of electrical components having as the clamping mode a screw-type clamping connection having one, two or more strips. In detail, there is proposed a plug-and-socket connector with screw-type connection, having an insulating part, arranged to accommodate at least one contact insert, the contact insert having a substantially cylindrical shape, comprising a contact portion for electrical/mechanical connection to an oppositely shaped contact piece of a matched plug-and-socket connector at a first end of the contact insert, and comprising an insertion opening for at least one connecting stranded conductor at a second end of the contact insert, there opening in the insertion opening a screw hole which is oriented substantially transversely relative to the central longitudinal axis thereof and comprises an internal thread, and the insulating part having a screw channel which is substantially in alignment with the screw hole of the when a contact insert is accommodated in the insulating part, the screw channel having at least one step, wherein the inside width of the screw channel reduces from a first, greater dimension towards a second, lesser dimension in the direction towards the screw hole of the insertion opening, and the screw channel has one or more strips which are oriented substantially coaxially relative to its central longitudinal axis of the and which are so dimensioned that a clamping screw to be inserted in the screw channel for the purpose of fastening the connecting stranded conductor in the insertion opening of the contact insert is subjected to a first, lesser resistance at the strip/strips of the first inside width, and is subjected to a second, greater resistance at the strip/strips of the second inside width.

The resistance in this case can be a braking moment (torque) or a resistance moment (torque). The step in this case can be recessed into the wall of the screw hole or realized by a jump from the more outwardly located strip/s to the more inwardly located strip/s. The contact insert can have a contact portion which is designed as a plug or as a socket. The insertion opening for the at least one connecting stranded conductor is oriented substantially coaxially relative to the contact portion. It can also, however, be oriented at an angle thereto, for example at right angles. The insertion opening can be designed as a hollow cylindrical blind hole; it is also possible to shape the insertion opening as an approximately groove-shaped receiver for the at least one connecting stranded conductor. The insulating part can be of a single piece or multiple pieces and made from a (also glass-fibre-reinforced) hard plastic, for example polycarbonate, polyvinyl chloride, polyethylene, crosslinked polyethylene, polyamide, polypropylene, polystyrene or the like. A wire protection part, of substantially J-shaped cross-section and having a limb which substantially covers the screw hole of the insertion opening, can be insertable in the insertion opening.

The screw channel can have two hollow cylindrical portions, which are separated by the at least one step and on the circumference of which the strip/s is/are distributed. The first portion in this case can have the first, greater inside width and the second portion can have the second, lesser inside width. Strips that are more distant from the screw hole can have a surface which is curved convexly towards the central longitudinal axis of the screw channel. Strips located closer to the screw hole can have a surface which is curved concavely towards the central longitudinal axis of the screw channel. The diameter of the inner circle, formed from the common tangents to the concave strips, has approximately the diameter of the screw head. Concavely curved surfaces of strips can have a radius of curvature which corresponds substantially to the radius of a head of a clamping screw that is to be inserted in the screw channel.

Strips can be arranged substantially over the entire length of the screw channel, except for an insertion chamfer. The extent of the strips along the central longitudinal axis of the screw channel can be so dimensioned that a clamping screw, during and after the insertion of its screw head in the region of strips that are more distant from the screw hole, is subjected to a mechanical resistance that increases when the screw head is located in the region of strips that are closer to the screw hole. If the screw head is located in the region of strips that are closer to the screw hole, it is possible to achieve, for a delivery state, a fixed screw-in depth at which a braking or clamping action occurs as the clamping screw is screwed in, which action prevents loosening or unscrewing of the clamping screw during transport. The fixed screw-in depth for the delivery state can be achieved when there remains a maximum opening width of the insertion opening, in order to ensure accommodation of the maximum connecting cross-section of the connecting stranded conductor. Three or more strips can be arranged with a uniform distribution along the circumference of the screw channel. In the insulating body, 2; 4; 6; 8; 10; 12; 14; 16; 20; 24; 48; 108 or 216 or more screw channels can be arranged in two or more substantially parallel rows. In contrast to former concepts, a braking action is ensured over the entire angle of rotation, for example by three or more strips, which braking action eliminates, inter alia, a non-circularity of a combination screw (slot+cross-slot).

Owing to the strips varying along the screw channel (being first convexly curved, then concavely curved), a varying, namely increasing, clamping or holding action is exerted upon the screw head when the clamping screw is inserted in the screw channel and then screwed into the internal thread of the screw hole in order to act upon a connecting stranded conductor present in the insertion opening (possibly with an interposed wire protection part), i.e., in order to clamp the connecting stranded conductor in place in the insertion opening in a vibration-proof manner and with minimum electrical transition resistance. The convex surface form of the strips in the "narrower" portion of the screw channel ensures a friction over the circumference of the screw head. The braking strips permit a greater number of screw cycles (opening+closing) of the clamping screw.

The torque discontinuity that occurs when the screw head reaches the "narrower" portion of the screw channel can be used as a reference for the screw-in depth in the case of automated processes for fitting of the clamping screw. This screw-in depth can be defined to ensure that the clamping screw of the contact is screwed in to such an extent that the opening in the clamping region allows the user to connect the greatest connecting cross-section of the connecting stranded conductor without first opening the clamping screw. Fitting time is saved as a result.

In addition, larger diameters of the shaft of cross-head screwdrivers can be used, such that, for example, it is also possible to use PH1 USA of shaft diameter 5 mm and PH1 Europe of shaft diameter 4.5 mm with the same insulating body. Since the inside width at the entrance of the screw channel is, for example, 5.1 mm, the convex shape of the strips in this region cannot be destroyed by a cross-head screwdriver of 5 mm diameter as the clamping screw is tightened. The step and transitions are matched in such a way that only the conical region of the tip of the screwdriver bit penetrates into this region, while the diameter of 5 mm of the screwdriver bit in the region of the greater inside width can only destroy the concave strips. Nevertheless, in the case of subsequent opening for the purpose of connecting a further conductor, owing to the second step protection against loss is maintained because of the convex shape of the strips.

Owing to the taper of the inside width even in the case of the strips of a few hundredths, for example four hundredths, of a millimetre, the inner circle of the second step is smaller than or equal to the inner circle of the first step. Otherwise, demoulding of the plastic tool and of the insulating body would not be possible. In the case of the material used and the given shape, forced demoulding is very difficult. In experiments, the combination with a small step of the strips (for example, approximately 0.04 mm) and a distinct difference in the shape of the strips (concave–convex) proved most effective for the functions, required in addition to protection against loss, of use of a PH1 Europe and USA screwdriver and of the torque step. The torque step is on the one hand measurably present in a region and at the same time is selected to be of such small magnitude that the clamping action of the screw shaft is not impaired by an insignificantly reduced tightening torque.

For a person skilled in the art, further features, characteristics, advantages and possible modifications of the plug-and-socket connector with screw-type connection are rendered evident by the following description, in which reference is made to the appended drawings.

SHORT DESCRIPTION OF THE FIGURES

In the figures, corresponding or comparable or comparably acting components or assemblies are denoted by corresponding symbols and/or reference numerals and generally explained at one point only.

DETAILED DESCRIPTION OF THE FIGURES

Figure 1:
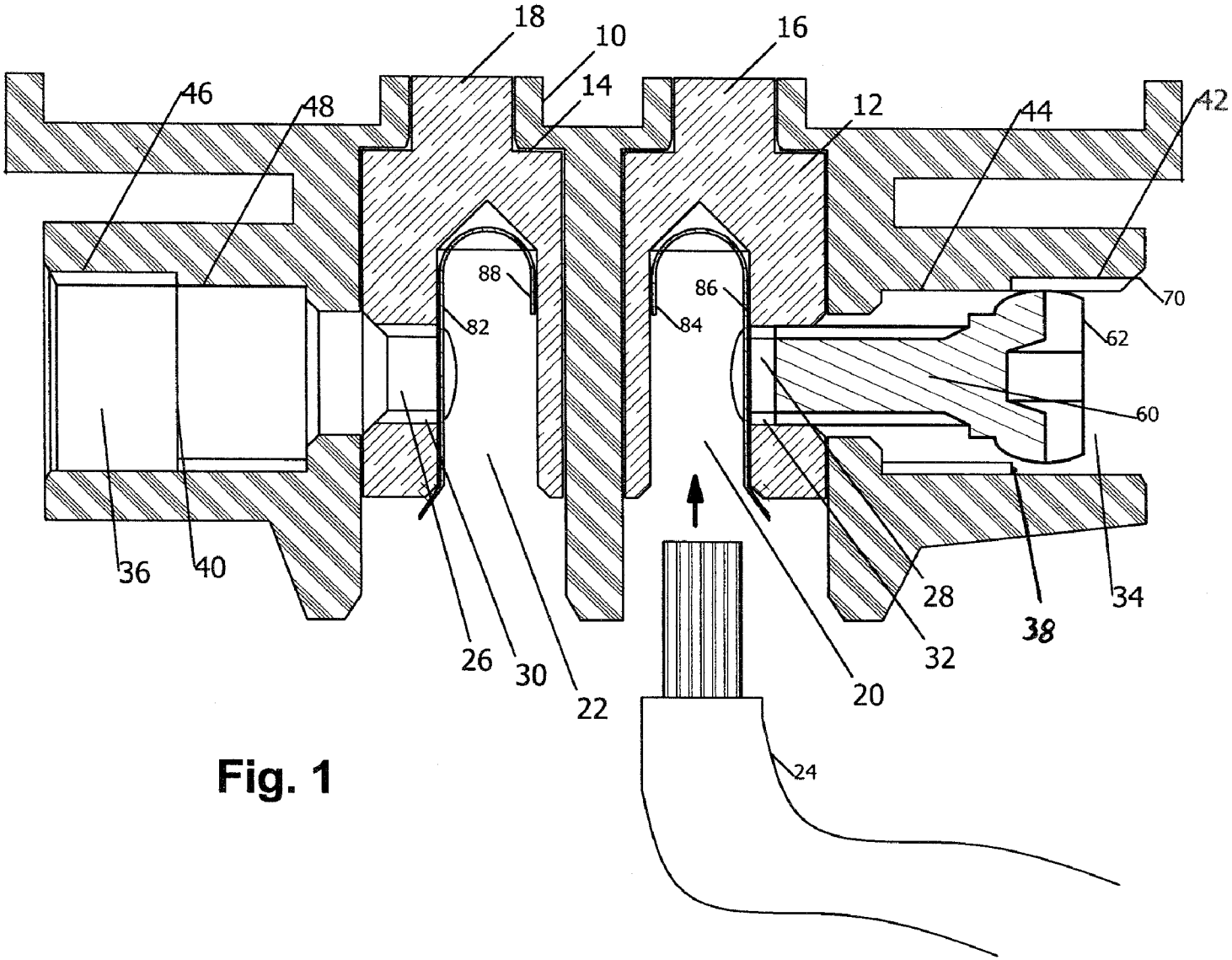
FIG. 1 shows a schematic, general cross-sectional representation of a plug-and-socket connector with screw-type connection.

FIG. 1 shows a schematic cross-sectional representation of a plug-and-socket connector with screw-type connection. In this case, a housing and fastening parts have been omitted for the sake of greater clarity. The plug-and-socket connector has an insulating part 10 with two rows of electrical contact inserts arranged in parallel to each other, of which one of the contact inserts 12, 14 is shown in each row in FIG. 1. It is understood in this case that, depending on the configuration of the plug-and-socket connector, 2, 4, 6, 10, 16, 24, 32, 48 or up to 216 and more contact inserts can be arranged in two or more substantially parallel rows in the insulating body 10. The contact inserts 12, 14 are inserted—captively, owing to the clamping screw 60—in the insulating body 10 of the plug-and-socket connector, for example encompassed by the material of the insulating body 10 during the injection moulding process for the insulating body 10.

Each of the contact inserts 12, 14 has a substantially cylindrical shape and is formed from a copper-containing alloy, possibly with a hard silver or hard gold coating. Each contact insert has a contact portion 16, 18, merely outlined in FIG. 1, which can be designed as a plug or as a socket for electrical/mechanical connection to an oppositely shaped contact piece of a matching plug-and-socket connector at a first end of the contact insert 12, 14, which end is at the top in FIG. 1. At the opposite, second end of the contact insert 12, 14, which end is at the bottom in FIG. 1, an insertion opening 20, 22 for at least one merely outlined connecting stranded conductor 24 is recessed into the cylindrical contact insert 12, 14 on the front face. In the insertion opening 20, 22, there opens in the contact insert 12, 14 a screw hole 26, 28 which is oriented substantially transversely relative to the central longitudinal axis thereof and which comprises an internal thread 30, 32. The central longitudinal axis of the insertion opening 20, 22 is oriented substantially coaxially relative to the contact portion 16, 18. The insertion opening 20, 22 is designed as a hollow cylindrical blind hole.

Figure 2:
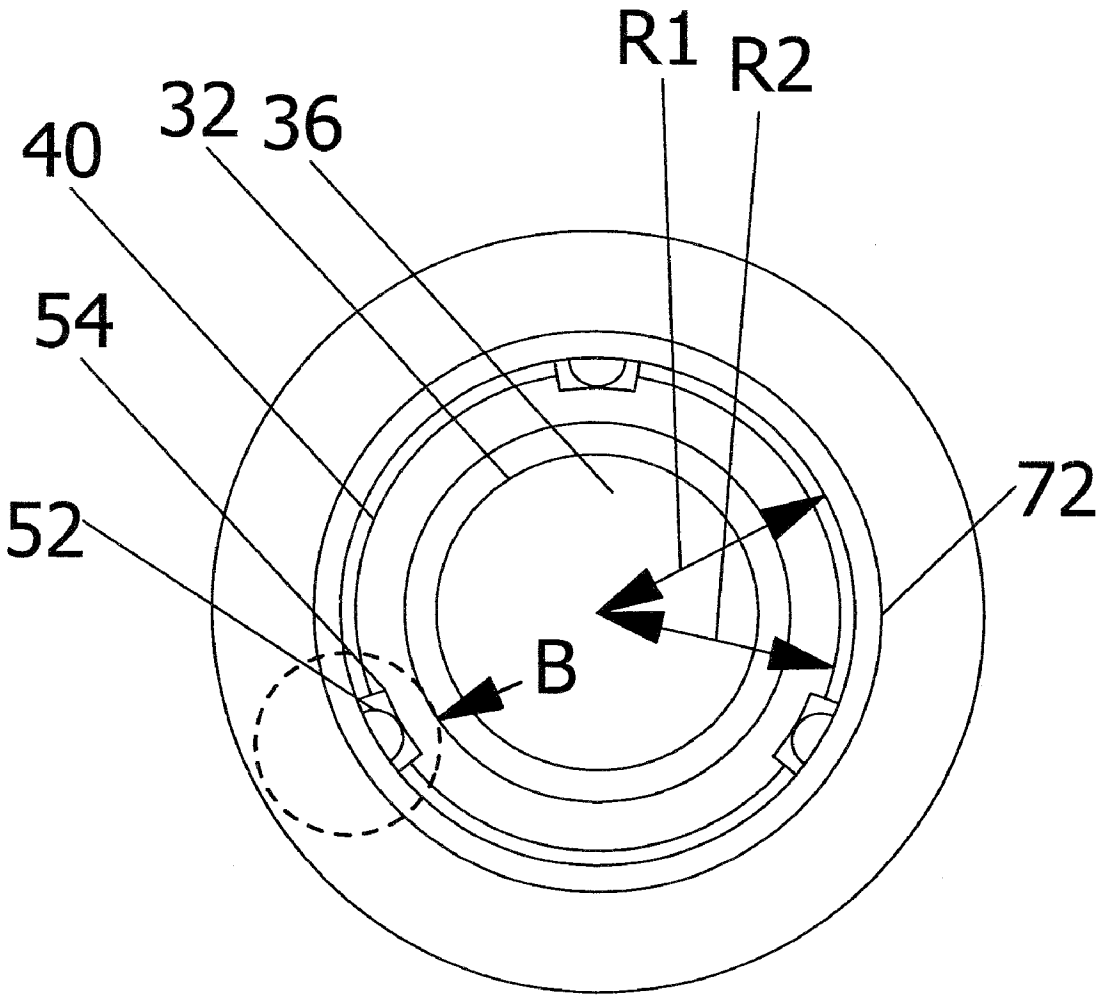
FIG. 2 shows a schematic lateral top view of a screw channel of a plug-and-socket connector from FIG. 1, without inserted clamping screw.
Figure 3:
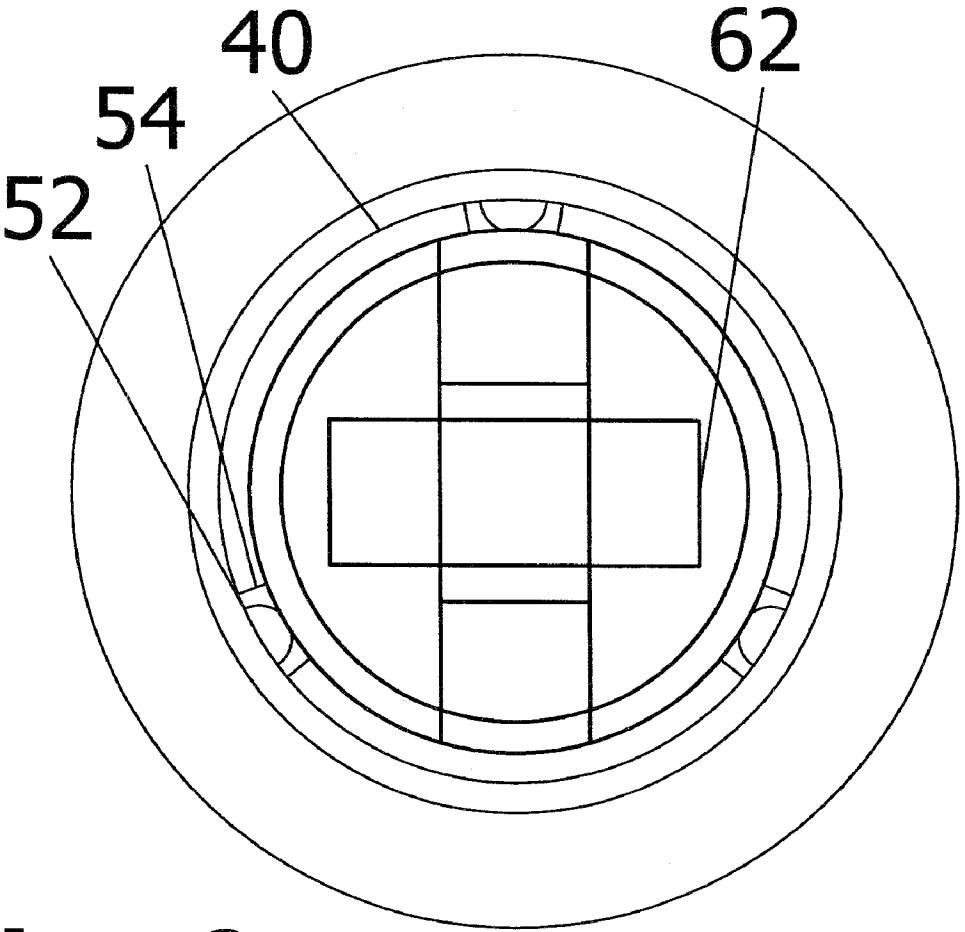
FIG. 3 shows a schematic lateral top view of a screw channel of a plug-and-socket connector from FIG. 1, with inserted clamping screw.
Figure 4:
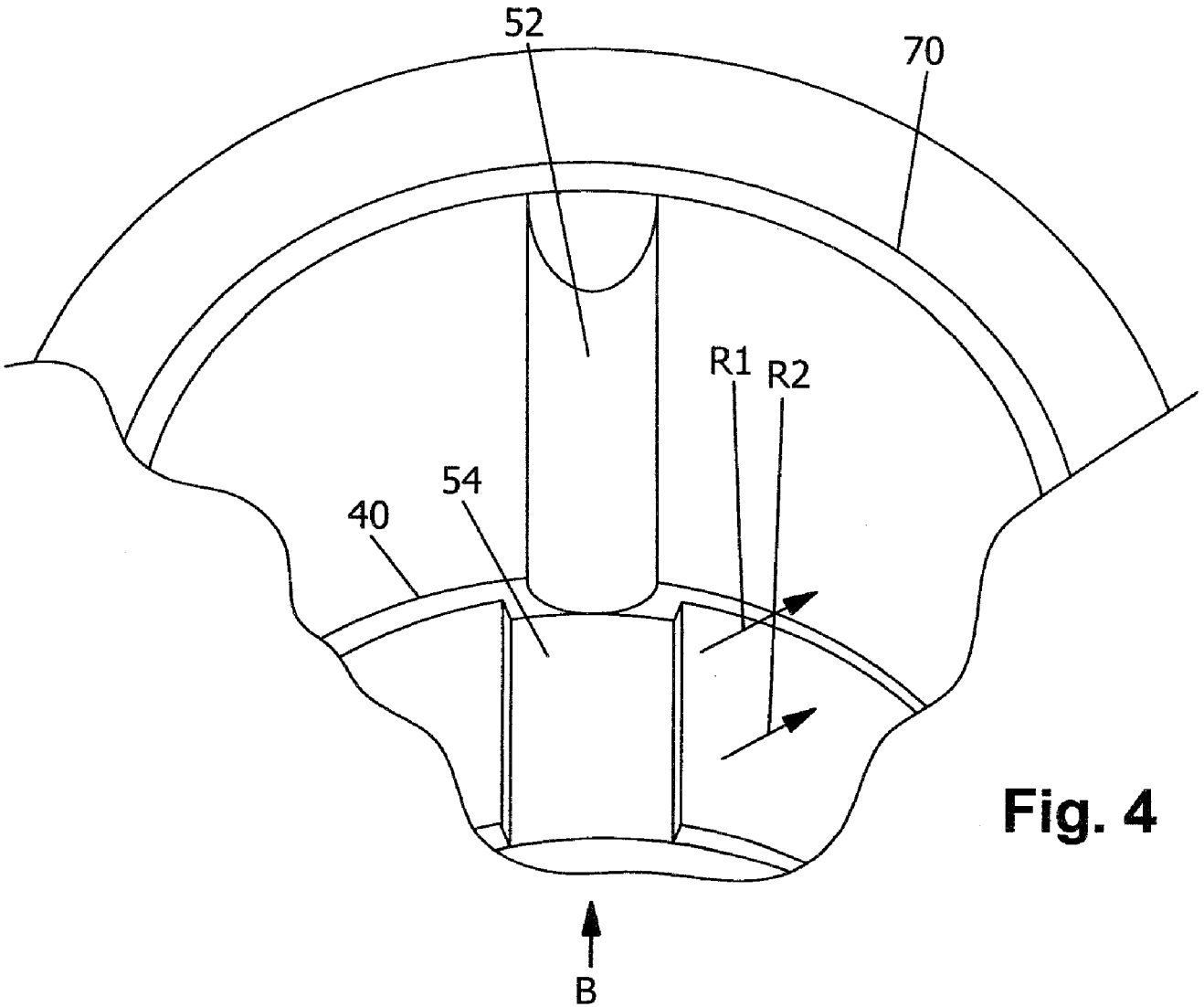
FIG. 4 shows an enlarged representation of a schematic perspective top view of a screw channel of a plug-and-socket connector from FIG. 1, without inserted clamping screw.

The insulating part 10 has a screw channel 34, 36, which is substantially in alignment with the screw hole 26, 28 in the contact insert 12, 14 when a contact insert 12, 14 is accommodated in the insulating part 10. The screw channel 34, 36 has two hollow cylindrical portions 42, 44; 46, 48, which are separated by at least one step 38, 40, the first portion 42, 46 having a first, greater inside width R1 (see FIGS. 2, 3), and the second portion 44, 48 having a second, lesser inside width R2 (see FIGS. 2, 3).

The screw channel 34, 36 has, in the region of the first portion 42, 46, three first strips 52 which are oriented substantially coaxially relative to the central longitudinal axis thereof and which are uniformly distributed on the circumference of the screw channel 34, 36 (at an angle of approximately 120 degrees relative to each other). These first strips 52 have a surface which is curved convexly towards the central longitudinal axis of the screw channel 34, 36. The screw channel 34, 36 has, in the region of the second portion 44, 48, three second strips 54 which are oriented substantially coaxially relative to the central longitudinal axis thereof. These second strips 54 are arranged in the axial extension of the first strips 52 and have a surface which is curved concavely towards the central longitudinal axis of the screw channel 34, 36. The second strips 54 are so dimensioned that a clamping screw 60 to be inserted in the screw channel 34, 36 for the purpose of fastening the connecting stranded conductor 24 in the insertion opening 20, 22 of the contact insert 12, 14 are subjected to a second holding force at the strips 54 of the lesser inside width. The second holding force in this case is greater than the first holding force to which the clamping screw 60 is subjected in the region of the first strips 52.

The concavely curved surfaces of the second strips 54 have a radius of curvature which corresponds substantially to the radius of a head 62 of a clamping screw 60 that is to be inserted in the screw channel 34, 36. The radial extent and shape of the strips 52, 54 along the central longitudinal axis of the screw channel 34, 36 are so dimensioned that a clamping screw 60, during and after the insertion of its screw head 62 in the region of strips 42, 46 that are more distant from the screw hole 26, 28, is subjected to a mechanical resistance that increases when the screw head 44, 48 is located in the region of the second strips 54 that are closer to the screw hole 26, 28. This is also due to the fact that, in the region of the outer first strips 52, the convex surfaces have a substantially punctiform area of contact with the head 62 of the clamping screw if the screw head 62 is in the shape of a universal ball joint or is lenticular, or they have a substantially linear area of contact if the screw head is cylindrical, while in the region of the second inner strips 54 the concave surfaces have a substantially linear area of contact with the head 62 of the clamping screw if the screw head 62 is in the shape of a universal ball joint or is lenticular, or they have a substantially flat area of contact if the screw head is cylindrical.

The two different strips can have a substantially equal radial extent relative to the central longitudinal axis of the screw hole. It is also possible, however, to have strips with a concave surface (i.e., the second strips 54 located closer to the screw hole) 28, 26 projecting further inwards. The first and second strips 52, 54 are arranged over the entire length of the screw channel 34, 36, except for an insertion chamfer 70, 72 on the screw channel 34, 36. A wire protection part 80, 82 of substantially J-shaped cross-section is to be inserted in the insertion opening, which wire protection part has a limb 84, 86 which covers the screw hole 28, 30 of the insertion opening 20, 22. The wire protection part 80, 82 is not present in the case of other variants. Via the wire protection part 80, 82, the shaft of the clamping screw presses the conductor strands onto the opposing wall of the bore for accommodating the conductor.

The wire protection part 80, 82 is made of high-grade steel and therefore has a spring action which ensures multiple connecting operations (at least 5 times smallest cross-section 0.5 $mm^2$, thereafter largest cross-section 2.5 $mm^2$), but a reduced electrical conductivity. Hence the "J shape" for the wire protection.

If the screw head 62 is located in the region of strips 54 closer to the screw hole, a fixed screw-in depth is achieved for a delivery state, at which depth a braking or clamping action occurs as the clamping screw is screwed in, which action prevents loosening or unscrewing of the clamping screw during transport.

The fixed screw-in depth for the delivery state is achieved when there remains a maximum opening width of the insertion opening, in order to ensure accommodation of the maximum connecting cross-section of the connecting stranded conductor.

The above description of a plug-and-socket connector serves for illustrative purposes only, and not for the purpose of limiting the concept or its realizations. Various alterations and modifications to the plug-and-socket connector are possible without no use being made of the concept, its realizations or equivalents thereof.

The invention claimed is:

1. Plug-and-socket connector with screw-type connection, having an insulating part, arranged to accommodate at least one contact insert, the contact insert having a substantially cylindrical shape, comprising a contact portion for electrical/mechanical connection to an oppositely shaped contact piece of a matched plug-and-socket connector at a first end of the contact insert, and comprising an insertion opening for at least one connecting stranded conductor at a second end of the contact insert, there opening in the insertion opening a screw hole which is oriented substantially transversely relative to the central longitudinal axis thereof and comprises an internal thread, and the insulating part having a screw channel which is substantially in alignment with the screw hole of the insertion opening when a contact insert is accommodated in the insulating part, the screw channel having at least one step, wherein the inside width of the screw channel reduces from a first, greater dimension (R1) towards a second, lesser dimension (R2) in the direction towards the screw hole of the insertion opening, and the screw channel having one or more strips which are oriented substantially coaxially relative to its central longitudinal axis of the and which are so dimensioned that a clamping screw to be inserted in the screw channel for the purpose of fastening the connecting stranded conductor or solid wire in the insertion opening of the contact insert is subjected to a first, lesser resistance at the strip/strips of the first inside width, and is subjected to a second, greater resistance at the strip/strips of the second inside width.

2. Plug-and-socket connector with screw-type connection according to claim 1, characterized in that the contact insert has a contact portion which is designed as a plug or as a socket.

3. Plug-and-socket connector with screw-type connection according to either of claim 1 or 2, characterized in that the insertion opening is oriented substantially coaxially relative to the contact portion.

4. Plug-and-socket connector with screw-type connection according to claim 1, characterized in that the insertion opening is designed as a hollow cylindrical blind hole.

5. Plug-and-socket connector with screw-type connection according to claim 1, characterized in that the insulating part is of a single piece or multiple pieces.

6. Plug-and-socket connector with screw-type connection according to claim 1, characterized in that a wire protection part, of substantially J-shaped cross-section and having a limb which covers the screw hole of the insertion opening, is to be inserted in the insertion opening.

7. Plug-and-socket connector with screw-type connection according to claim 1, characterized in that the screw channel has two hollow cylindrical portions, which are separated by the at least one step and which have the strip/s distributed on their circumference, the first portion having the first, greater inside width (R1) and the second portion having the second, lesser inside width (R2).

8. Plug-and-socket connector with screw-type connection according to claim 1, characterized in that strips that are more distant from the screw hole have a surface which is curved concavely towards the central longitudinal axis of the screw channel.

9. Plug-and-socket connector with screw-type connection according to claim 1, characterized in that strips located closer to the screw hole have a surface which is curved convexly towards the central longitudinal axis of the screw channel.

10. Plug-and-socket connector with screw-type connection according to claim 9, characterized in that convexly curved surfaces of strips have a radius of curvature which corresponds substantially to the radius of a head of a clamping screw that is to be inserted in the screw channel, the diameter of an inner circle, formed from the common tangents to the convex strips, preferably having approximately the diameter of the screw head.

11. Plug-and-socket connector with screw-type connection according to claim 1, characterized in that strips are arranged substantially over the entire length of the screw channel, except for an insertion chamfer.

12. Plug-and-socket connector with screw-type connection according to claim 1, characterized in that the extent of the strips along the central longitudinal axis of the screw channel are so dimensioned that a clamping screw, during and after the insertion of its screw head in the region of strips that are more distant from the screw hole, is subjected to a resistance moment (torque) that increases when the screw head is located in the region of strips that are closer to the screw hole.

13. Plug-and-socket connector with screw-type connection according to claim 1, characterized in that, if the screw head is located in the region of strips that are closer to the screw hole, a fixed screw-in depth is achieved for a delivery state, at which depth a braking or clamping action occurs as the clamping screw is screwed in, which action prevents loosening or unscrewing of the clamping screw during transport.

14. Plug-and-socket connector with screw-type connection according to claim 13, characterized in that when the fixed screw-in depth for the delivery state is achieved when there remains a maximum opening width of the insertion opening, in order to ensure accommodation of the maximum connecting cross-section of the connecting stranded conductor.

15. Plug-and-socket connector with screw-type connection according to claim 1, characterized in that three strips are arranged with a uniform distribution along the circumference of the screw channel.

16. Plug-and-socket connector with screw-type connection according to claim 1, characterized in that in the insulating body, 2; 4; 6; 8; 10; 12; 14; 16; 20; 24; 48; 108 or 216 screw channels are arranged in two or more substantially parallel rows.

* * * * *